United States Patent [19]

Flinn et al.

[11] 4,147,533

[45] Apr. 3, 1979

[54] PROCESS FOR THE PRODUCTION OF FERRO-MAGNESIUM AND THE LIKE

[76] Inventors: Richard A. Flinn, 140 Underdown Dr.; Paul K. Trojan, 3939 Vorhies Rd., both of Ann Arbor, Mich. 48105

[21] Appl. No.: 814,345

[22] Filed: Jul. 11, 1977

[51] Int. Cl.[2] ..... C21C 7/02

[52] U.S. Cl. ..... 75/58; 75/130 R; 75/135

[58] Field of Search ..... 75/58, 130, 135, 129

[56] References Cited

U.S. PATENT DOCUMENTS

| | | | |
|---|---|---|---|
| 2,485,760 | 10/1949 | Millis | 75/130 R |
| 2,869,857 | 1/1959 | Kopke | 266/34 |
| 3,080,228 | 3/1963 | Hale | 75/130 R |
| 3,157,492 | 11/1964 | Matuschokovitz | 75/51 |
| 3,177,071 | 4/1965 | Ebert | 75/130 R |
| 3,285,739 | 11/1966 | Christensen | 75/130 R |
| 3,290,142 | 6/1966 | Loomis | 75/130 R |
| 3,321,304 | 5/1967 | Snow | 75/130 R |
| 3,375,104 | 3/1968 | McClellan | 75/130 R |
| 3,544,312 | 12/1970 | Turillon | 75/130 R |
| 3,598,572 | 8/1971 | Robertson | 75/130 R |

OTHER PUBLICATIONS

Trojan & Flinn, "A New Method for Determination of Liquid-Liquid Equilibrium as Applied to the Fe-C-Si-Mg System", *Transactions of the ASM*, pp. 549-567 (vol. 54, 1961).

*Primary Examiner*—P. D. Rosenberg
*Attorney, Agent, or Firm*—Donald E. Degling

[57] ABSTRACT

A process and apparatus are disclosed for the production of a solid metallic composition such as ferromagnesium wherein one constituent has a melting point which is above the boiling point of the second constituent. In accordance with the disclosed process, a liquid melt of the first constituent is formed which has an effective depth sufficient to produce a static pressure head in excess of the vapor pressure of the second constituent at the temperature of the melt. The second constituent is then melted and mixed with the first constituent to form a liquid mixture wherein at least a portion of the second constituent is in solution with the first constituent. The mixture is then solidified rapidly to form a solid metallic composition in which a substantial part of the second constituent appears as a dispersion of fine particles of the second constituent in a matrix of the first constituent. The apparatus includes a columnar furnace communicating with a reaction chamber to provide the requisite pressure within the reaction chamber, an adder mechanism to supply the low-boiling point constituent to the pressurized reaction chamber and means to cool and solidify the liquid mixture rapidly so as to form the desired dispersion of fine particles of the low-boiling point constituent in a matrix of the other constituents.

10 Claims, 9 Drawing Figures

FIG. 6
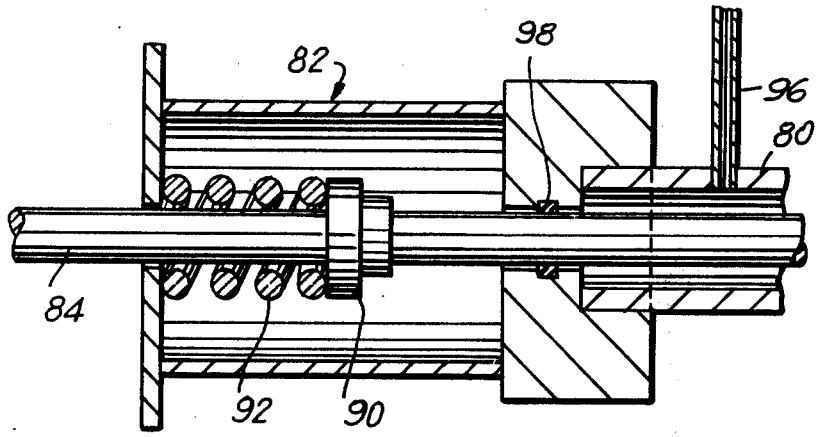
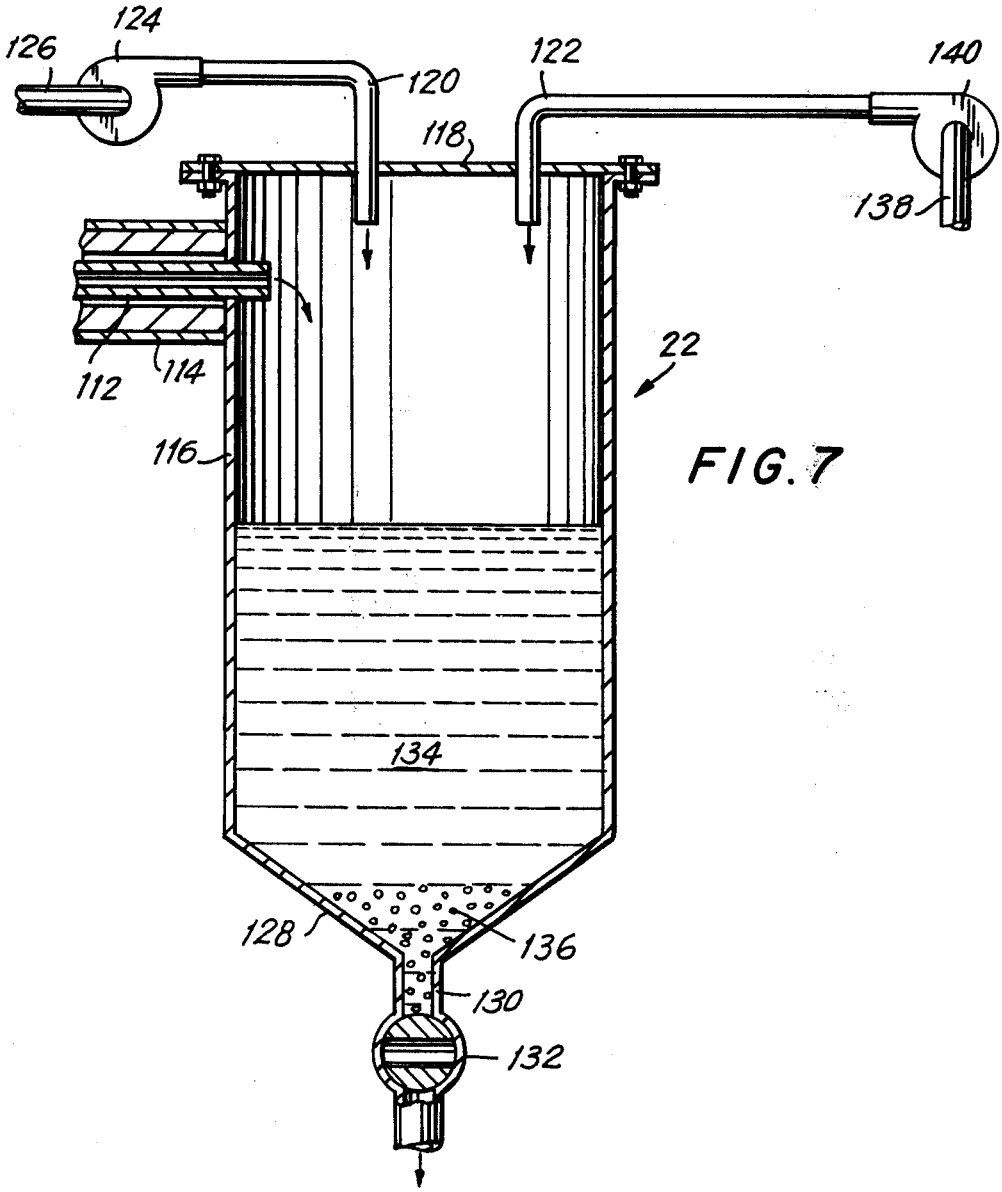
FIG. 7

PROCESS FOR THE PRODUCTION OF FERRO-MAGNESIUM AND THE LIKE

BACKGROUND OF THE INVENTION

1. Field of the Invention

This invention relates to a process and apparatus for producing ferro-magnesium.

During the 1940's it was discovered that the graphite contained in ordinary gray cast iron compositions could be altered from its normal flake form to a nodular form by the addition of relatively small quantities of magnesium. The basic process was disclosed in the Millis, et al. U.S. Pat. No. 2,485,760. Essentially, gray cast iron consists of a steel matrix whose continuity is disrupted by a myriad of graphite flakes dispersed throughout the matrix. These graphite flakes are particles of leaf or saucer shape, formed by the precipitation of excess carbon as graphite from the liquid during solidification. It was then discovered that a small amount (e.g., 0.05%) of magnesium dissolved in the liquid iron would cause the formation of spheroidal graphite instead of flake graphite from the melt. Although the phase amounts and analyses of ductile or nodular iron are the same as those for ferritic gray cast iron, the difference in the shape of the graphite results in twice the tensile strength and twenty times the ductility. The development of nodular iron, among other things, created a need for a magnesium-containing product suitable as an addition agent for the treatment of molten ferrous products.

2. Description of the Prior Art

It has long been known that magnesium was an effective desulfurizer and degasifer of non-ferrous metals but magnesium reacts violently with molten iron and is soluble in iron only to a small degree. Hence, in the production of nodular iron the magnesium has been introduced in various combined forms such as ferrosilicon magnesium (see U.S. Pat. Nos. 3,177,071, 3,290,142, 3,367,771 and 3,375,104), coke or charcoal impregnated with magnesium (see U.S. Pat. Nos. 3,321,304 and 3,598,572), combinations of rare earths and magnesium and alloys of magnesium and nickel or copper (see U.S. Pat. Nos. 3,030,205 and 3,544,312).

However, in all cases the addition of the magnesium or magnesium alloy has been accompanied by the evolution of smoke and flaring due to the reaction of magnesium with the heated atmosphere. Attempts have been made to plunge the magnesium addition agent beneath the surface of the liquid cast iron in the ladle by means of a plunging bell or a gaseous stream. See, for example, U.S. Pat. Nos. 2,869,857, 3,080,228, 3,157,492 and 3,285,739. Another approach has been to place the magnesium additive in the bottom of the ladle, cover it with scrap steel punchings and then tap the liquid iron into the ladle.

Although these mechanical devices represent an improvement, they are only partially successful and typically 50% or more of the magnesium is lost. Not only is the loss of the magnesium an economic disadvantage, but also the concomitant production of smoke, fume and flaring is unacceptable in view of the ever more stringent statutes and regulations relating to air quality.

Another approach to the problem is through the use of various alloys. However, alloys containing substantial quantities of silicon and magnesium are considerably less dense than iron and tend to float to the surface of the liquid iron bath. Moreover, the usual liquid iron temperatures are above the boiling point of magnesium at atmospheric pressure and therefore the magnesium vaporizes almost immediately. As a result, only a small amount of the added magnesium has an opportunity to dissolve in the liquid iron before the bubbles of vapor reach the surface of the iron melt and escape to the atmosphere. It is believed that these two effects, i.e., the low density of the silicon-magnesium additives and the low boiling point of magnesium are principally responsible for the low efficiencies of the magnesium additives as used heretofore.

In an attempt to avoid these problems, a number of processes have been suggested. These processes may be classified as follows: (1) processes using pure magnesium in the ladle under high pressure, (2) introduction of pure, solid magnesium through an opening located in the lower part of the treatment ladle, (3) processes where the vaporization of the magnesium is delayed by passage through an inert porous material, and (4) processes where the magnesium is diluted as an alloy or ferrous agglomerate. This classification was suggested in a recent article entitled "Simple and Economic Use of Pure Magnesium in the Production of Spheroidal Graphite (Ductile) Iron" by Henri Jarysta which appeared in the *Proceedings of the International Magnesium Association* for 1976 at pp. 49–52. Mr. Jarysta concluded that the above processes all had the disadvantages of either requiring sophisticated and expensive installation or resulting in excessive additive cost and recommended the use of small magnesium ingots coated with an isolating refractory.

Other researchers have directed their attention to the desulfurization of pig iron by the addition of magnesium and developed methods for the introduction of magnesium, magnesium alloys and magnesium-entrained coke into the bath similar to those systems developed for making nodular iron. Some of the mechanical systems involve (1) pressurized tubes through which magnesium ingots are submerged in the bath, (2) tilting reactors, (3) pneumatic injection of powdered or granular magnesium, (4) refractory-coated magnesium ingots and (5) wire injection. As shown in an article entitled "The Kinetics of Magnesium Vapour Dissolution Into Pig Iron" by Gordon A. Irons and R. L. Guthrie which appeared in the *Proceedings of the International Magnesium Association* for 1976 at pp. 63–72, this work has focused on the question of dissolution of vaporized magnesium into pig iron.

SUMMARY OF THE INVENTION

The present invention is directed to a process and apparatus for the production of ferro-magnesium in a form suitable for use as a nodulizing agent for the production of nodular iron and as a desulfurizing agent for gray iron, nodular iron, hot metal or steel.

Applicants have recognized that the usual nodulizing agents are deficient in several respects. First, those agents which include substantial amounts of silicon or other low density elements tend to float in the ladle and thus require expensive and cumbersome apparatus for introduction into the bath of molten iron. Second, nodulizing agents including substantial amounts of nickel may have a density approaching that of molten iron and thus will have little tendency to float in the ladle. However, such nodulizing agents may be expensive and may introduce undesirable elements into the molten iron.

From an operational viewpoint, the most desirable nodulizing agent is one which permits substantially full recovery of the added magnesium, i.e., none of the magnesium is lost through vaporization and flaring, and introduces no spurious materials into the melt. Ferro-magnesium is one such material but, as noted above, the boiling temperature of magnesium is below the melting temperature of iron at atmospheric pressure. Thus, it is difficult to produce ferro-magnesium without the use of special pressure vessels.

Applicants have overcome these production difficulties by providing a process wherein ferro-magnesium containing more than 0.40% magnesium, and preferably more than 1.00% magnesium can be produced in a reactor in which the molten iron itself provides a superatmospheric pressure. The ferro-magnesium may be produced in the form of an ingot, a bar or as shot or pellets. Where the ferro-magnesium product takes the form of a bar or shot, the process may be conducted in a continuous manner while where the product is an ingot, the process is usually a batch process. The product, in addition to magnesium and iron, may contain carbon and silicon and other incidental elements, for example, 4% carbon and 1% silicon and thus comprise a cast iron composition containing substantial amounts of magnesium.

The ferro-magnesium product made by the process of the present invention is characterized by the fact that, in addition to the small amount of magnesium dissolved by the iron, the major portion of the magnesium appears as a dispersion of magnesium in a matrix of iron. Such a product is ideally suited as a nodulizing agent since, in the presence of additional liquid iron the dispersed magnesium particles will tend to dissolve rather than form large bubbles of vapor which may easily escape from a molten iron bath.

The effect of the particles of magnesium dispersed in the iron matrix leads to efficient solution of the magnesium in a liquid iron bath. This, of course, is in sharp contrast to the use of ingots or bars of pure magnesium which melt and vaporize in the presence of molten iron under atmospheric or slightly superatmospheric pressures.

In accordance with the process of the present invention, molten iron is tapped into a heated tundish-like receptacle mounted at or near the upper end of a furnace preferably of columnar shape which communicates at a lower level with a reactor, which is preferably heated, so as to pressurize the reactor with a superatmospheric pressure established by the head of molten iron above the reactor. Molten magnesium is introduced into the reactor at a rate sufficient to provide the desired proportions of magnesium and iron in the final product. The reactor is sized in proportion to the furnace and magnesium adder and the reactor and adder are specially adapted to promote the dissolution and dispersion of a maximum amount of magnesium into the molten iron. Preferably, the mixture of magnesium and iron is then cooled rapidly so as to form a dispersion of particles of magnesium in a solution of magnesium and iron. The step of rapid cooling may be performed in a chill mold if the process is to be performed as a batch process. Preferably, the process is performed as a continuous process, in which case the step of rapid cooling comprises either the conversion of the mixture into shot or pellets in a shotting chamber or the casting of the mixture into billets or bars by a continuous casting process. Thus the ferro-magnesium product may be in the form of ingots, billets, bars, shot or pellets.

The present invention also incorporates novel apparatus. In order to prevent boiling of the liquid magnesium when the magnesium is brought into contact with liquid iron, a furnace preferably of columnar shape is located, at least in part, above the reactor. The effective height of the furnace is determined by the operating temperature of the iron and is selected so that the static head at the reactor is greater than the vapor pressure of magnesium at the predetermined operating temperature. Preferably, the columnar furnace is fitted with controllable heating means to insure that the predetermined temperature of the molten iron is maintained.

The reactor is a closed and preferably heated vessel designed to promote the admixture of the liquid iron and magnesium to promote dissolution and dispersion of magnesium by the liquid iron and to inhibit any reverse flow of the mixture and solution backwards into the furnace. The magnesium adder preferably includes a heated chamber adapted to contain and melt a number of magnesium bars. The melted magnesium is then metered into the reactor as a thin stream by means of the pressure exerted at one end of the chamber by an inert gas. Alternatively, magnesium may be introduced into the reactor in the form of a solid magnesium wire. The opposite end of the reactor communicates with a chill mold, a shotting chamber or a continuous casting machine as may be desired.

Further features of the invention will appear in the following detailed description of the invention taken in conjunction with the accompanying drawings in which:

FIG. 6 is an enlarged vertical section of another portion of the magnesium adder taken along line 6—6 of FIG. 1.

FIG. 7 is a vertical section in schematic form showing a shotting chamber positioned adjacent the outlet of the reactor.

DETAILED DESCRIPTION OF THE INVENTION

Figures 1, 2:
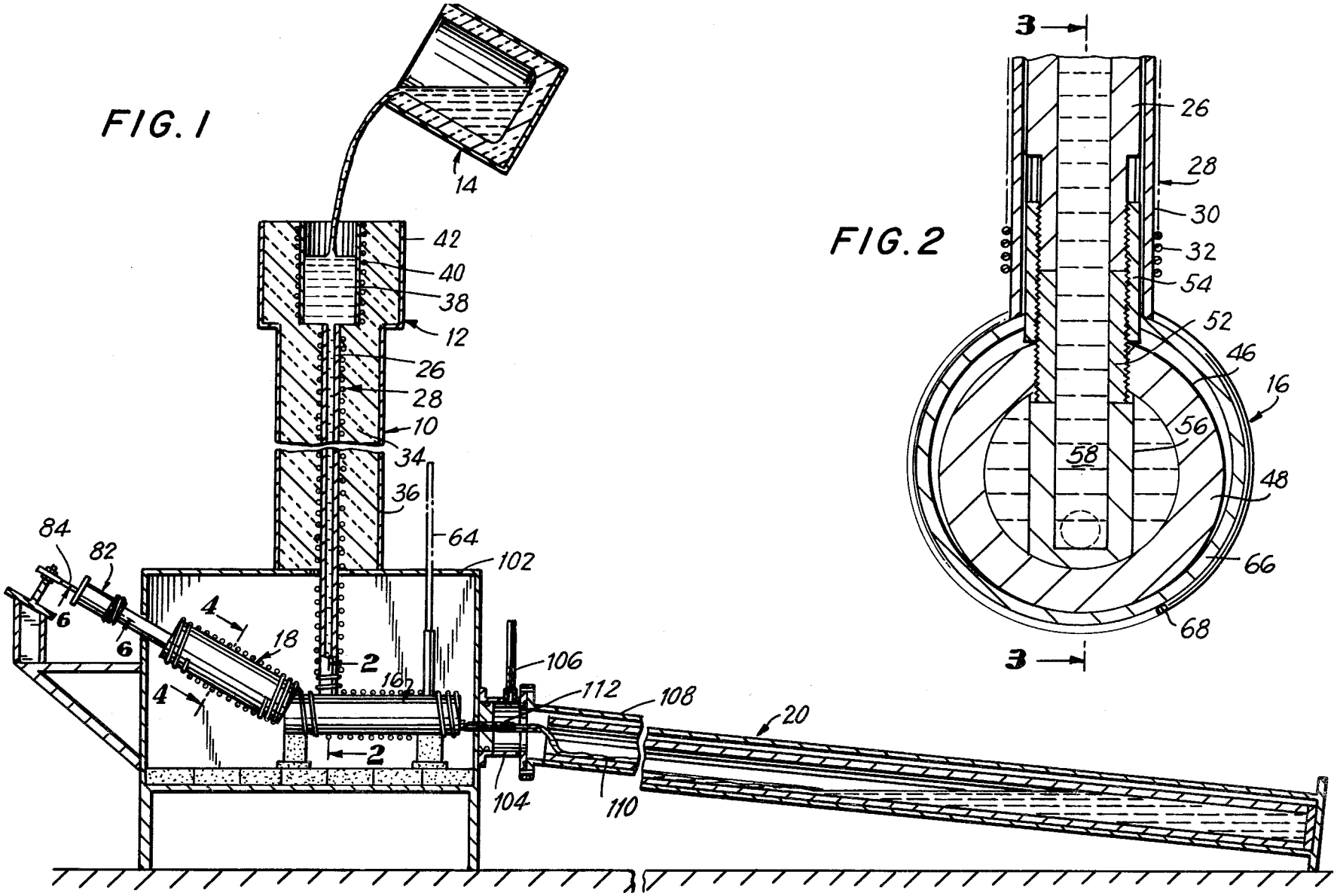
FIG. 1 is a vertical cross-section in schematic form and partially broken away of an apparatus for practicing the process of the present invention showing the columnar furnace, the reactor, the magnesium adder and a chill pressure mold.
FIG. 2 is an enlarged vertical section of a portion of the apparatus taken along line 2—2 of FIG. 1 showing a section through the reactor and the lower portion of the columnar furnace.
Figure 8:
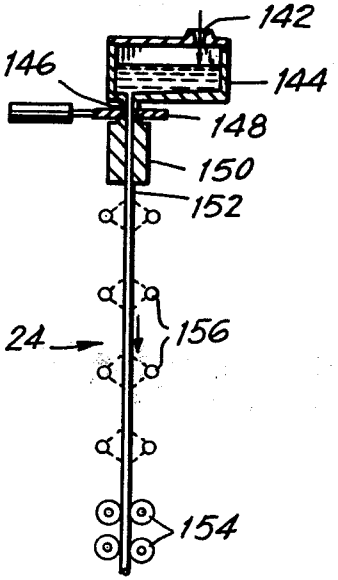
FIG. 8 is a schematic view of a continuous casting machine positioned adjacent the outlet of the reactor.

Referring now to the drawings and particularly FIG. 1, 10 indicates a columnar furance communicating at its upper end with a heated tundish 12 fed from a source of molten iron or hot metal 14. At its lower end, the columnar furnace 10 communicates with a heated reactor 16. A magnesium adder 18 delivers molten magnesium to one end of the reactor 16 and ferro-magnesium is withdrawn from the opposite end of the reactor. As shown in FIG. 1, the ferro-magnesium product is then solidified into bars or ingots in a pressurized mold 20. Alternatively, the ferro-magnesium product may be formed into shot or pellets in a shotting chamber 22 (FIG. 7) or as a bar or billet in a continuous casting machine 24 (FIG. 8).

Returning to FIG. 1, the columnar furnace 10 comprises a hollow cylindrical pipe-like core 26 preferably formed from graphite and surrounded by a heater 28. As shown more clearly in FIG. 2, the heater 28 may comprise a ceramic tube 30 about which a resistance element 32 is wound. Although only a single resistance element 32 is indicated in the drawings, it will be appreciated that the heating element 32 may comprise a series of separate and individually variable heaters whereby a desired temperature profile may be established in the furnace. Refractory material 34 is formed around the outside of heater 28 and the furnace and refractory is contained in a steel shell 36. As noted above, the vertical height of the columnar furnace 10 is a function of the operating temperature of the molten iron. Table I below shows the relationship between the vapor pressure of magnesium and the height of a column of iron required to produce an equivalent pressure head at various temperatures:

TABLE I

| Temperatures (° F.) | Magnesium Vapor Pressure (psia) | Equivalent Iron Column (in.) |
|---|---|---|
| 2050 | 15.0 | 1.2 |
| 2100 | 21.2 | 26.0 |
| 2150 | 26.8 | 48.4 |
| 2200 | 32.0 | 69.2 |
| 2250 | 39.6 | 99.6 |
| 2300 | 47.5 | 131.2 |
| 2350 | 57.2 | 169.2 |
| 2400 | 68.4 | 213.6 |
| 2450 | 81.0 | 264.0 |
| 2500 | 92.7 | 310.0 |

From Table I it is apparent, for example, that if it is desired to introduce magnesium into liquid metal at a temperature of 2400° F. without boiling of the magnesium, a pressure in excess of the magnesium vaporization pressure of 68.4 psia must be provided. If 2400° F. is selected, the liquid metal must contain carbon in excess of 1.2% and preferably in excess of 3% so as to be entirely in the liquid phase. Such a pressure may be produced by a column of iron 213.6 inches high. Thus, if an operating temperature of 2400° F. is selected, the effective height of the columnar furnace must be somewhat in excess of 213.6 inches. It will be appreciated that the principal purpose of the columnar furnace is to provide the requisite pressure head and that, at the end of any heat, the iron contained in the furnace cannot be treated. Therefore, to minimize the amount of untreated metal, the inside diameter of the furnace core 26 should be kept at a minimum consistent with the desired flow rate of iron through the apparatus and the ability of the apparatus to maintain consistent temperatures.

At the upper end of the columnar furnace 10 there is located a tundish-like vessel 12 which comprises a refractory shell 38, preferably made from graphite, a heater 40 formed around, but electrically insulated from, the shell 38, appropriate refractory material 42 formed around the tundish shell 38 and heater 40, and an outer steel shell 42. The tundish 12 may be formed integrally with the columnar furnace 10 or may be a separate unit in juxtaposition with the furnace 10. In constrast with the furnace 10, the tundish 12 is designed so that its diameter is relatively large compared with its height whereby the operating head of molten metal may be maintained substantially constant. As shown in FIG. 1, the lower end of the furnace 10 communicates with the reactor. It will be appreciated that the furnace may communicate with the reactor alternatively at any point above its lower end provided that the effective height of the furnace is sufficient to provide the requisite static head at the level of the reactor.

Figures 3, 9:
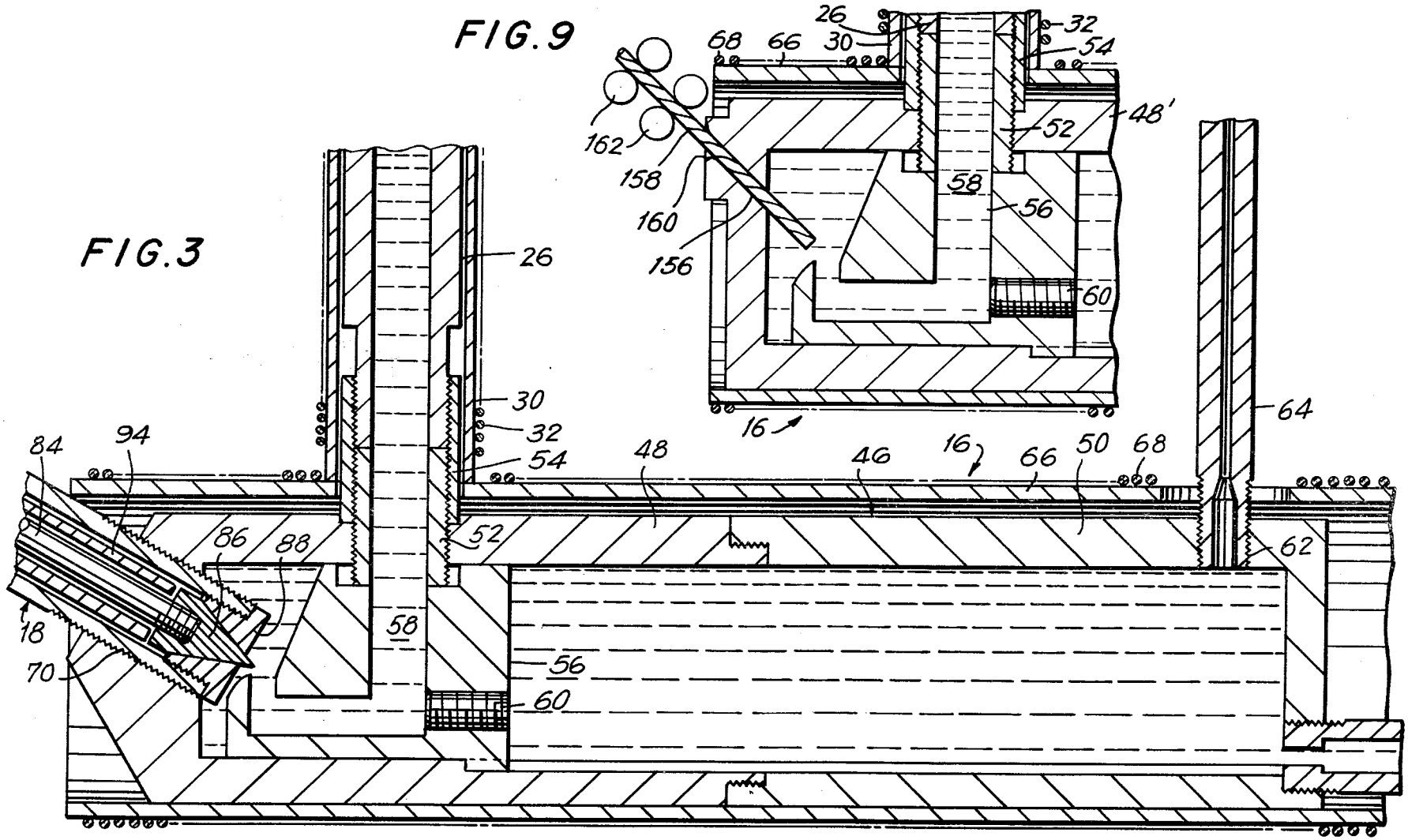
FIG. 3 is an enlarged vertical section of the reactor and associated parts taken along line 3—3 of FIG. 2.
FIG. 9 is an enlarged vertical section of a portion of the reactor and furnace shown in FIG. 3 but showing an alternative means for introducing magnesium into the reactor.
Figure 5:
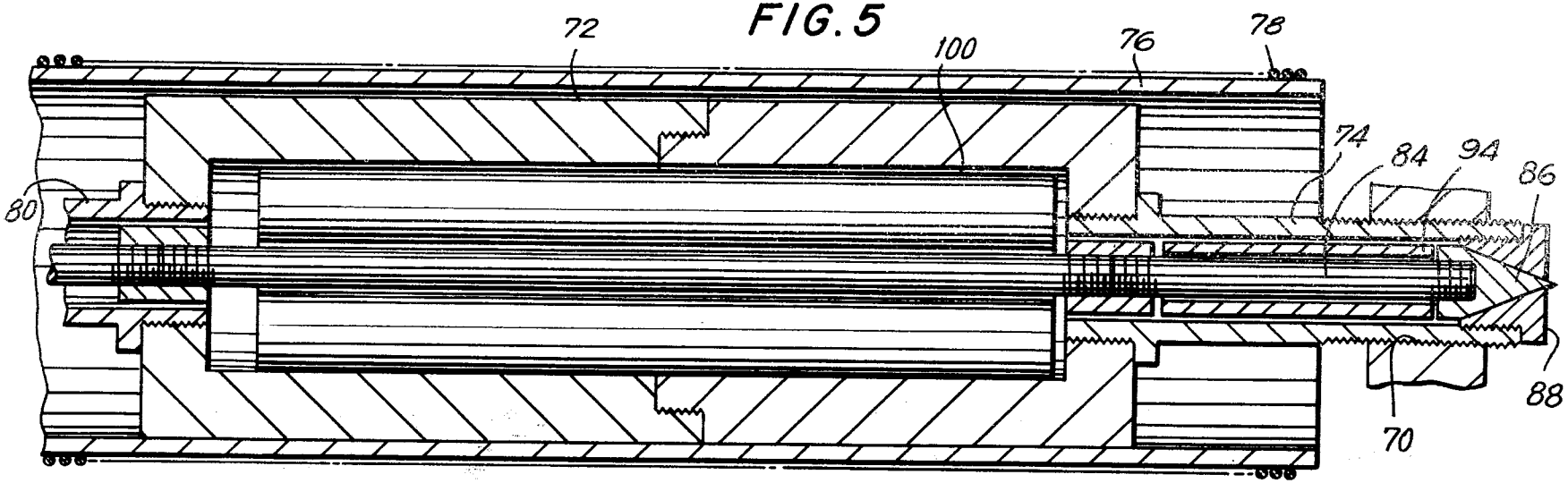
FIG. 5 is an enlarged vertical section of a portion of the magnesium adder taken along line 5—5 of FIG. 4.
Figure 4:
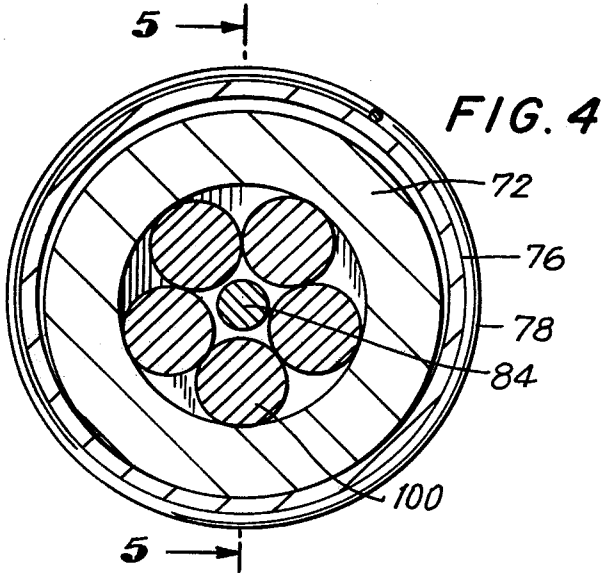
FIG. 4 is an enlarged cross-sectional view of the magnesium adder taken along line 4—4 of FIG. 1.

The lower end of the columnar furnace 10 is connected to a reactor 16 as shown most clearly in FIGS. 2 and 3. The reactor may comprise a refractory cylinder 46, preferably formed from graphite. Preferably, the refractory cylinder 46 comprises an assembly of threadedly joined cup-like portions 48, 50. A threaded graphite sleeve 52 is assembled into a threaded hole formed in graphite cup 48 while a graphite coupling 54 joins the lower end of the furnace core 26 and the graphite sleeve 52. Within the graphite cup 48 is located a guide block 56, also preferably fabricated from graphite. The guide block 56 has formed therein a generally J-shaped passage 58, the longer leg of which is aligned with the bore of the sleeve 52 while a shorter leg terminates in an orifice situated near the axis of the graphite cup 48. As shown in FIGS. 2 and 3, the guide block 56 is formed so that its upper and lower edges mate with a portion of the inner surface of the refractory cylinder 46 while its lateral surfaces are displaced from the inner surface of the refractory cylinder 46. It will thus be appreciated that molten metal flowing through the columnar furnace passes through the J-shaped passage 58 of the guide block 56 and then passes around the guide block toward the rear of the reactor. The plug 60 is provided as a convenience to fill the hole formed in the rear wall of the guide block 56 during boring of the bottom leg of the J-shaped passage 58. A threaded orifice 62 is provided in the top region of the cup-like portion 50 of the reactor body opposite the columnar furnace 10 into which is threaded a freeze tube 64. The freeze tube 64 communicates with the interior of the reactor and provides an escape passage for air initially contained within the reactor. It will be appreciated that the molten metal entering the reactor will first drive out the air contained in the reactor and then will itself enter the freeze tube. Due to the small bore of the freeze tube, the molten metal will solidify rapidly and thereby seal the freeze tube and the reactor 16. As soon as the reactor is sealed, the pressure within the reactor will approach a pressure determined by the head of molten metal in the columnar furnace 10. In order to control the temperature of the molten metal within the reactor 50, the reactor 16 is preferably encased within a ceramic tube 66 around which a heating element 68 is wound. A magnesium adder 18 communicates with the reactor 16 through an inclined threaded orifice 70 (FIG. 3). As shown in FIGS. 4 and 5, the magnesium adder comprises a cylindrical body 72 made from a refractory material, preferably graphite. The adder body 72 is preferably formed from two cup-like portions threadedly connected together. A threaded sleeve 74 positions the adder body 72 in the threaded orifice 70 of the reactor 16. A ceramic tube 76 bearing a heating element 78 surrounds the adder body 72. At the outward end of the adder a nipple 80 is threaded into the adder body 72 and carries a spring loading mechanism 82 on its free end (FIG. 6). A valve stem 84 is positioned for axial movement along the axis of adder 18 and carries on the end adjacent to the reactor a needle valve 86 which seats in valve seat 88 threadedly connected to the sleeve 74. At the opposite end of the valve stem 84 there is mounted a stop 90. A spring 92 surrounds the valve stem 84 and biases the needle valve 86 into the closed position. The valve stem 84 may be integral or, as shown in FIG. 5, it may be fabricated from a series of rods and couplings. Where the stem 84 is of substantially smaller diameter than the bore of the sleeve 74, it may be desirable to provide a graphite sleeve 94 to provide a more uniform passageway. If desired, the sleeve 94 may be made from aluminum in order to provide pretreatment and degasification of the reactor 16.

A tube 96 communicating with a source of inert pressurized gas is connected to the nipple 80 so as to pressurize the adder body. An O-ring seal 98 seals the valve stem 84 from the spring loading mechanism 82 and prevents escape of the pressurizing fluid therebetween. The heating element 78 provides sufficient heat to melt the magnesium bars 100 contained in the adder body 72 to form liquid magnesium which may then be forced into the reactor by pressurized inert gas whenever the needle valve 86 is opened.

While a single magnesium adder 18 has been illustrated in the drawings and described above, it will be appreciated that a second magnesium adder of similar design may be located in juxtaposition with the first adder to provide additional liquid magnesium when the charge in the first adder has been exhausted. By alternately recharging the magnesium adders, the operation of the apparatus may be rendered continuous.

An alternative apparatus for introducing magnesium into the reactor is shown schematically in FIG. 9 wherein portions common to the reactor shown in FIG. 3 bear the same identification numbers while similar parts are indicated by a primed identification number. The body of the reactor 48' is formed with an angularly disposed orifice 156 sized to receive a solid magnesium wire 158 while maintaining the pressure within the interior region of the reactor 16. To promote the entry of the wire 158, the outer end of the orifice 156 may be flared as shown at 160. The magnesium wire 158 may be supplied from appropriate reel or spool means (not shown) and fed into the reactor 16 at a controlled rate by means of one or more sets of pinch rolls 162. The magnesium wire 158 will be delivered to the region of the outlet of the J-shaped passage 58 formed in the guide block 56. As a result of the relatively high temperatures within the reactor, the magnesium wire will quickly melt and become dissolved or dispersed within the iron melt to form a mixture of iron and magnesium.

Returning now to FIG. 1, the columnar furnace 10, reactor 16 and adder 18 may be mounted on an appropriate frame 102. A collar 104 having a flange on its free end is fastened to the frame 102 and carries a tap 106 for directing an inert pressurizing gas into the collar. To the flange of the collar 104 is connected a flanged pipe 108, the oppposite end of which is closed and sealed. As shown in FIG. 1, the pipe 108 is inclined with the flanged end higher than the closed end. A refractory tube 110, preferably formed from graphite and having one end closed is disposed within the flanged pipe 108. A spout 112 communicates between the reactor 16 and pressurized mold 20 through the collar 104.

In operation, molten iron is tapped from a ladle or other source of molten iron 14 into the tundish 12 and thence into the columnar furnace 10. The molten metal passes through the J-shaped passage 58 of the guide block 56 and fills the reactor 16. After the air initially contained in the reactor has been purged and the reactor sealed by the freezing of the molten iron in the freeze tube 64, a pressure measured by the level of the molten metal in the tundish 12 is established. Prior to charging the columnar furnace with molten metal, the heater 78 of the adder 18 will have been activated so as to melt the magnesium bars contained therein into liquid form.

As soon as the reactor 16 has been pressurized to a point above the vapor pressure of magnesium at the temperature prevailing within the reactor, the valve stem 84 is activated so as to meter liquid magnesium at a predetermined rate into the stream of molten iron emerging from the short leg of the J-shaped passage 58 of the guide block 56. It will be appreciated that introducing the liquid magnesium into the iron at a point above the bottom of the J-shaped inhibits any tendency of the magnesium to flow into the columnar furnace where, as a result of decreasing pressure, boiling would occur. The reactor 16 is sized to provide sufficient retention time for the iron to become substantially saturated with magnesium. Any excess magnesium will be dispersed throughout the iron bath. The amount of magnesium that can be dissolved in iron varies with the temperature and composition of the metal. See "A New Method for Determination of Liquid—Liquid Equilibrium as Applied to the Fe-C-Si-Mg System" by P. K. Trojan and R. A. Flinn, *Transactions of the ASM* Vol. 54, 1961, pp. 549–566. Considering a molten metal containing 4% carbon, 0% silicon and the balance essentially iron, at 2600° F. such a composition can dissolve about 2.4% magnesium. At 2300° F. the same composition can dissolve about 1.4% magnesium, the balance of the magnesium being rejected as liquid magnesium, probably in the form of fine spherical droplets dispersed throughout the iron bath.

As an example of the process of the present invention, a heat was made wherein Sorel pig iron and 75% ferrosilicon were melted in an electric furnace to produce 214 pounds of iron containing 4.28% carbon and 1.23% silicon. Two pounds of magnesium in the form of sticks were placed in the magnesium adder.

The tundish of the columnar furnace was 9 inches high and 4¾ inches inside diameter while the columnar furnace had an inside diameter of ¾ inch and a total height of about 13 feet.

The reactor was formed from a graphite tube having an inside diameter of 2½ inches and an outside diameter of 4 inches. The inside length of the reactor was 15 inches. A freeze tube having an inside diameter of ⅛ inch and a height of 9 inches was mounted near the exit end of the reactor which was provided with a tapping port ¼ inch in diameter. The magnesium adder was also formed from a graphite tube having an inside diameter of 2½ inches and an inside length of about 10 inches. The adder was arranged at an angle of 30° upwardly from the horizontal axis of the reactor. Two magnesium sticks each 0.9 inch in diameter and about 10 inches long were charged into the adder. An aluminum tube 2½ inches long, 1 inch outside diameter and 9/16 inch inside diameter was placed in the adder nozzle ahead of the magnesium sticks. The diameter of the orifice of the adder nozzle was 3/64 inch.

The pressure chill mold for this heat comprised a six inch diameter steel pipe 9 feet long which contained a graphite liner 9 feet long having an inside diameter of 4 inches and an outside diameter of 5¼ inches. The pipe and graphite liner were inclined downwardly from the horizontal axis of the reactor at an angle of about 6°.

Prior to the beginning of the heat, the columnar furnace was preheated to a temperature ranging over its height from 2000° to 2040° F. The reactor was also heated to a temperature in the range of 2000° to 2040° F. and soaked for ½ hour. The magnesium adder was preheated to 1590° F. while the tundish was preheated to 1680° F.

The molten metal was poured into the tundish at a temperature of 2425° F. and reached a maximum temperature of 2255° F. in the reactor at about 40 seconds after the pour began. A log of the heat indicates the following:

| Time (seconds) | Observations |
|---|---|
| 0 | Start pour - 2425° F. |
| 3 | Metal observed flowing from reactor |
| 9 | Pouring cup full |
| 10 | Start pressurizing mold |
| 12 | Flow rate of metal from reactor reduced |
| 16 | Mold at 23 psig |
| 19 | Magnesium addition started. Pressure on magnesium adder 48 psig |
| 26 | Magnesium vapor clouded sight tube. Magnesium addition continued. |
| 70 | Magnesium addition stopped by closing adder |
| 92 | Pouring cup empty |
| 140 | Magnesium flare at top of column due to loss of head of iron with residual magnesium left in reactor |

An ingot weighing about 207 pounds was produced in this heat. As a result of the time lag between the start of the pour and the beginning of the magnesium addition, the first portion of the ingot contained only a small amount of magnesium but the portion of the ingot corresponding to the portions of the heat fully treated with magnesium in the reactor showed magnesium contents of 0.45 and 0.46%. The magnesium appeared principally as a fine dispersion of magnesium in a matrix of cast iron containing a small amount (less than 0.10%) of dissolved magnesium. While the method of chill casting utilized in this example involved relatively rapid cooling, the quantity of dispersed magnesium in the final product is dependent upon the cooling rate of the magnesium-containing ferro-magnesium bath. Thus, higher quantities of dispersed magnesium may result from the use of higher cooling rates as in the shotting method of casting discussed hereafter.

A fine dispersion of magnesium in iron is equivalent for the purposes of the present invention with a solution of magnesium in iron but an agglomeration of the magnesium into large particles is disadvantageous. The reason for this is that magnesium is relatively less dense than iron and therefore particles or drops of magnesium will tend to rise upwardly in a bath whose principal ingredient is iron and will soon vaporize to form bubbles of gaseous magnesium. The bubbles of gaseous magnesium will rise rapidly through the bath to join the atmosphere above the bath. For the purposes of the present invention, a "large" particle of magnesium is defined as one which will vaporize at least in substantial part instead of dissolving in the iron-containing bath under the pressure and temperature conditions present in the bath. A "small" particle of magnesium may be defined correlatively as one which will dissolve in the liquid iron bath without substantial vaporization. In order to inhibit the formation of large magnesium particles or an agglomeration of magnesium particles in the ferro-magnesium, it is important to maintain the ferro-magnesium melt at a pressure above the vapor pressure of magnesium while cooling the melt rapidly. When this is done the magnesium rejected by the melt during cooling will remain in the form of fine particles. A proper control of the pressure and temperature conditions during cooling will result in an iron composition containing maximized amounts of finely dispersed magnesium in an iron matrix. Of course, the matrix will contain a small amount of dissolved magnesium, e.g., less than about 0.1% magnesium. In FIG. 1 there is shown a pressurized chill mold apparatus which is designed to maintain a pressurized inert atmosphere within the mold while the cast bar is cooled rapidly.

An alternative procedure for pressurized chill casting is the shotting or pelletizing step illustrated schematically in FIG. 7. Spout 112 communicates between the reactor 16 and the shotting chamber 22 and is preferably surrounded by an insulated sleeve 114 fastened at one end to the reactor frame 102 and at the other end to the tank 116 of the shotting chamber 22. The tank 116 is sealed at the top by a lid 118 through which pass pressurizing tube 120 and liquid return tube 122. Pressurizing tube 120 may be connected to a pump 124 and thence via conduit 126 to a source of inert gas (not shown). The inert gas may be argon or another gas considered to be inert to both iron and magnesium which can be supplied in the usual high pressure cylinder fitted with an appropriate pressure regulator. The bottom 128 of the tank 116 is preferably conical in shape and has an outlet 130 closed by a rotary valve 132. A liquid quenching medium 134, e.g., oil, partially fills the tank 116.

Molten metal substantially saturated with magnesium in the reactor is sprayed through the spout 112 into the shotting chamber 22. The molten metal tends to form droplets of generally spherical configuration which are then solidified into shot or pellets 136 as they pass through the liquid quenching medium 134. Periodically a portion of the pellets 136 and liquid quenching medium 134 are withdrawn through the outlet 130 and valve 132. The pellets and liquid may be separated and the liquid quenching medium returned to the tank 116 via conduit 138, pump 140 and tube 122. If desired, the liquid quenching medium may pass through a heat exchanger (not shown) or filter (not shown) so as to maintain conditions of constant temperature and quenching medium quality within the shotting chamber 22.

Inasmuch as the shotting chamber 22 is pressurized in order to inhibit the vaporization of the magnesium droplets present in the ferro-magnesium melt, it becomes possible, alternatively, to introduce magnesium into the stream of liquid metal within the shotting chamber as a supplement to the magnesium introduced in the reactor or, in some instances, in place of the magnesium introduced in the reactor. Of course, the efficiency and uniformity of the magnesium addition may be lower under these circumstances since there is less time available for complete dissolution and mixing of the magnesium with the iron of the bath.

It will be appreciated that the shotting process can be performed continuously even though the pellets 136 and excess quenching medium are withdrawn periodically. Also, it is unnecessary that the pellets be of any particular size or precise configuration. Nevertheless, by appropriate design of the outlet of the spout 112, the droplets of molten metal formed thereby will tend to be uniform in size and this will, in turn, promote uniformity in the size of the ultimate pellets. Of greater import is the fact that composition of the pellets will be substantially uniform as a result of the continuous operation of the reactor.

In FIG. 7, shotting is accomplished by directing a stream of molten ferro-magnesium into a pressurized chamber containing a quenching medium. It will be appreciated that other shotting techniques may also be employed. For example, a jet of inert gas may be directed into a stream of liquid ferro-magnesium, preferably from below the stream, to atomize the stream into droplets whereby fine pellets are formed. Another modification is the use of a mechanical device such as a paddle or impeller to mechanically break up the stream of liquid ferro-magnesium and direct the droplets into a quenching medium.

Although ferro-magnesium in the form of pellets is a desirable product for use as a nodulizing agent for the production of nodular iron or the desulfurization of hot metal, there may be occasions when it is desired to prepare the ferro-magnesium in the form of bars or billets. FIG. 8 illustrates in schematic form the casting of bars or billets of ferro-magnesium in a continuous casting machine. Liquid ferro-magnesium may be directed from the reactor 16 into the inlet 142 of a pressurized tundish 144. The outlet 146 communicates through a hot metal valve 148 with a water-cooled continuous casting mold 150 of conventional design. The continuous casting mold 150 is sized to produce the desired cross sectional shape for the cast bar or billet 152 and may be of the single or multiple strand type as desired. The bar or billet 152 may be withdrawn from the mold 150 by appropriate pinch rolls 154. Intermediate the mold 150 and the pinch rolls 154 there may be positioned appropriate spray cooling devices 156.

While the process and apparatus described above has been directed principally toward the production of a nodulizing agent, it will be appreciated that magnesium is a highly effective desulfurizer and will preferentially react with sulfur. However, the problem of utilizing magnesium as a desulfurizer for melts of ferrous metals is similar to the problems encountered in the direct use of magnesium as a nodulizing agent. Accordingly, the process of liquid magnesium injection under a static pressure head to prevent boiling as the ferro-magnesium product of the present invention may also be used as a desulfurizer for melts of ferrous metals.

It has long been known that in the process of making nodular iron, the added magnesium will first react with sulfur and certain other elements such as titanium before it is effective to control the shape of the graphite. Therefore, if the chemical analysis of the base iron is known, the process of the present invention may be used to produce nodular iron directly. Since the amount of retained magnesium required to produce nodular iron (e.g., 0.05%) is less than the solubility level of magnesium in iron (i.e., about 0.10%) the ferro-magnesium product as direct nodular iron may be withdrawn from the reactor and cast into ingots or end-products at ambient pressure. In this form of the invention, the efficiency in the use of the magnesium is high since little, if any, magnesium is lost as a vapor.

Up to this point the disclosure has been directed toward a method and apparatus useful in preparing ferromagnesium. It will be noted that the basic problem arises because the melting temperature of iron at ambient pressures is higher than the boiling temperature of magnesium. This condition, however, is not unique to the iron-magnesium system but also occurs in other systems involving iron. Among such other systems are the iron-lithium and iron-strontium systems. In Table II below, the appropriate data for these systems are presented:

TABLE II

| | Lithium | | Strontium | |
|---|---|---|---|---|
| Temperature (° F.) | Vapor Press. (psia) | Equiv. Iron Col. (in.) | Vapor Press. (psia) | Equiv. Iron Col. (in.) |
| 2400 | 11.5 | — | 11.0 | — |
| 2500 | 16.6 | 7.6 | 15.7 | 4.0 |
| 2600 | 23.6 | 35.6 | 22.0 | 29.2 |
| 2700 | 32.5 | 71.2 | 30.1 | 61.6 |
| 2800 | 44.1 | 117.6 | 40.5 | 103.2 |
| 2900 | 58.5 | 175.2 | 53.3 | 154.4 |
| 3000 | 76.1 | 245.6 | 69.0 | 217.2 |
| 3100 | 98.0 | 333.2 | 88.6 | 295.6 |

In Table III, below, corresponding data for the iron-calcium system are presented:

TABLE III

| | Calcium | |
|---|---|---|
| Temperature (° F.) | Vapor Press. (psia) | Equiv. Iron Col. (in.) |
| 2400 | — | — |
| 2500 | — | — |
| 2600 | — | — |
| 2700 | 14.1 | — |
| 2800 | 19.5 | 19.2 |
| 2900 | 26.4 | 46.8 |
| 3000 | 35.1 | 81.6 |
| 3100 | 46.3 | 126.4 |

In Table IV, below, data for the iron-sodium system are presented:

TABLE IV

| | Sodium | |
|---|---|---|
| Temperature (° F.) | Vapor Press. (psia) | Equiv. Iron Col. (in.) |
| 2100 | 103.1 | 354 |
| 2200 | 141.7 | 508 |
| 2300 | 190.3 | 702 |
| 2400 | 250.4 | 943 |
| 2500 | 323.4 | 1235 |
| 2600 | 410.8 | 1584 |
| 2700 | 513.9 | 1997 |

From Table II it will be noted that the boiling point for lithium and strontium is not reached until the iron melt exceeds 2400° F. Reference to the iron, iron carbide equilibrium diagram discloses that the iron must contain at least about 3% carbon to be entirely in the liquid phase at this temperature. Thus, if it is desired to introduce lithium or strontium into iron containing less than about 3% carbon the present process is applicable.

From Table III it can be noted that the boiling point for calcium is reached at a temperature between 2700° and 2800° F. Steels containing less than about 0.7% carbon begin to solidify at temperatures in this range. Thus, if it is desired to introduce calcium into such steels, or into pure iron, the present process is applicable.

From Table IV it can be noted that, as in the iron-magnesium system, the boiling point of sodium is reached before the melting point of the iron. Thus, the process of the present invention is applicable.

The above examples illustrate that the process and apparatus of the present invention may be employed in various situations where it is desired to form alloys or mixtures of metallic materials where the boiling point of one of the constituents is below the melting point of the other constituent. Of course, either of the constituents may itself be an alloy or mixture of two or more elements.

The terms and expressions which have been employed are used as terms of description and not of limitation and there is no intention, in the use of such terms and expressions, of excluding any equivalents of the features shown and described or portions thereof, but it is recognized that various modifications are possible within the scope of the invention claimed.

What is claimed is:

1. A process for the production of a solid metallic composition containing at least two metallic constituents wherein the melting temperature of a first constituent exceeds the boiling temperature of a second constituent at atmospheric pressure said process comprising forming a liquid melt of said first constituent, forming said liquid melt into a liquid body having a depth at least sufficient to produce a static pressure head therein in excess of the vapor pressure of said second constituent at the temperature of the melt, providing a supply of said second constituent, introducing said first constituent as a liquid melt at a static pressure head in excess of the vapor pressure of said second constituent into a reaction chamber, metering said second constituent at a predetermined rate into said reaction chamber, retaining said first and said second constituents in said reaction chamber to form a mixture of said constituents in which at least a portion of said second constituent is in solution with said first constituent, withdrawing said mixture from said reaction chamber and solidifying said mixture at a static pressure head in excess of the vapor pressure of said second constituent and at a sufficiently rapid rate to retain a portion of said second constituent rejected from said mixture during cooling thereof as a dispersion of small particles of said second constituent in a matrix of said first constituent.

2. A process as set forth in claim 1 wherein said first constituent comprises a melt of ferrous material and said second constituent is selected from the group consisting of magnesium, sodium, strontium, lithium and calcium.

3. A process for the production of a ferrous composition containing a dispersion of magnesium particles comprising forming a liquid melt of ferrous material, forming said liquid melt into a liquid body having a depth at least sufficient to produce a static pressure head therein in excess of the vapor pressure of magnesium at the temperature of said melt, providing a supply of magnesium, introducing said liquid melt at a static pressure in excess of the vapor pressure of magnesium at the temperature of said melt into a reaction chamber, metering said magnesium at a predetermined rate into said reaction chamber, retaining said magnesium and said melt in said reaction chamber to form a mixture of magnesium and said ferrous material in which at least a portion of the magnesium is in solution, withdrawing said mixture from said reaction chamber and solidifying said mixture at a static pressure head in excess of the vapor pressure of said second constituent and at a sufficiently rapid rate to retain a portion of the magnesium rejected from said solution during cooling and solidification thereof as a dispersion of small particles of magnesium in a matrix of the ferrous composition.

4. A process for the preparation of nodular iron comprising forming a liquid melt of cast iron composition, forming said liquid melt into a body of liquid metal having a depth at least sufficient to produce a static pressure head therein in excess of the vapor pressure of a nodulizing agent at the temperature of said melt, providing a supply of said nodularizing agent, introducing said liquid melt of cast iron composition at a static pressure in excess of the vapor pressure of said nodulizing agent at the temperature of said melt into a reaction chamber, metering said nodulizing agent at a predetermined rate into said reaction chamber, reacting said melt of cast iron composition and said nodulizing agent in said reaction chamber to form nodular iron and withdrawing said nodular iron from said reaction chamber.

5. The process set forth in claim 4 in which the nodulizing agent is magnesium.

6. The process set forth in claim 5 in which the cast iron composition contains 3.4 to 4.0% carbon, 2.0 to 2.8 silicon, balance substantially iron and incidental impurities.

7. The process set forth in claim 6 wherein the retained magnesium content of the nodular iron is in the range of 0.02 to 0.07%.

8. A process for the desulfurization of ferrous melts comprising forming a liquid melt of ferrous material containing sulfur, forming said liquid ferrous melt into a liquid body having a depth at least sufficient to produce a static pressure head therein in excess of the vapor pressure of a desulfurizing agent at the temperature of said melt, providing a supply of said desulfurizing agent, introducing said liquid ferrous melt at a static pressure in excess of the vapor pressure of the desulfurizing agent at the temperature of said melt into a reaction chamber, metering said desulfurizing agent at a predetermined rate into said reaction chamber, reacting said liquid ferrous melt containing sulfur with said desulfurizing agent to form a slag containing a sulfide, and withdrawing said ferrous melt and said slag from said reaction chamber.

9. The process set forth in claim 8 wherein the desulfurizing agent is magnesium.

10. A process as set forth in claim 9 in which the quantity by weight of magnesium introduced into the reaction chamber is equal to at least 75% of the quantity by weight of the sulfur desired to be removed from the ferrous melt.

* * * * *

UNITED STATES PATENT OFFICE

CERTIFICATE OF CORRECTION

Patent No. 4,147,533 Dated April 3, 1979

Inventor(s) Richard A. Flinn and Paul K. Trojan

It is certified that error appears in the above-identified patent and that said Letters Patent are hereby corrected as shown below:

Column 5, line 68 "constrast" should be --contrast--.

Claim 4, Column 14, line 18 "nodularizing" should be --nodulizing--

Signed and Sealed this

*Eleventh* Day of *September 1979*

[SEAL]

*Attest:*

LUTRELLE F. PARKER

*Attesting Officer* *Acting Commissioner of Patents and Trademarks*